United States Patent [19]

Pegram

[11] Patent Number: 4,844,540

[45] Date of Patent: Jul. 4, 1989

[54] COMBINATION BEACH TOWEL AND CHAIR COVER

[76] Inventor: Robert C. Pegram, 26 Guinevere Ct., Baltimore, Md. 21237

[21] Appl. No.: 260,687

[22] Filed: Oct. 21, 1988

[51] Int. Cl.[4] ..... A47G 9/00; A47C 31/10

[52] U.S. Cl. ..... 297/229; 5/417; 5/496; 5/498

[58] Field of Search ..... 5/417, 482, 496, 498, 5/420; 297/224, 229; D6/602, 603

[56] References Cited

U.S. PATENT DOCUMENTS

| | | | |
|---|---|---|---|
| D. 280,170 | 8/1985 | Short | D6/608 |
| 1,841,410 | 1/1932 | Karr | 5/498 |
| 2,099,427 | 11/1937 | Karr | 5/498 |
| 2,696,872 | 12/1954 | Kurland et al. | 297/229 |
| 4,273,380 | 6/1981 | Silvestri | 297/191 |
| 4,536,028 | 8/1985 | Jones et al. | 297/224 |
| 4,553,785 | 11/1985 | Duke, Jr. et al. | 297/229 |
| 4,656,670 | 4/1987 | Schluter | 2/92 |
| 4,671,568 | 6/1987 | Greer | 297/229 |
| 4,768,252 | 9/1988 | Ross | 5/498 |

*Primary Examiner*—Alexander Grosz
*Attorney, Agent, or Firm*—Leonard Bloom

[57] ABSTRACT

A combination beach towel and chair cover comprises a rectangular fabric towel having a first elastic strap at one end and a pair of elastic straps attached angularly at the second end of the towel. The towel may be mounted on an end of the chair by the first strap encircling the end of the chair and the pair of elastic straps encircling a second end of the chair.

12 Claims, 3 Drawing Sheets

COMBINATION BEACH TOWEL AND CHAIR COVER

FIELD OF THE INVENTION

The present invention relates to the beach towels and covers for various types of chairs.

BACKGROUND OF THE INVENTION

Persons going to the beach, using swimming pools or lounging in the sun usually place a large towel on the sand or ground, or cover a beach or patio chair with a towel. The towel serves several purposes when covering a chair. The plastic webbing of the chair becomes very hot in the sun and the towel permits the user to lie down without discomfort. Also, the towel absorbs perspiration, adding to the comfort of the user. Furthermore, the towel prevents the user from having imprints of the chair on their legs and back. In addition, the towel serves as a clean cover for the chairs which have been left in the weather and accumulated deposits of dust. Still further, the towel absorbs water which drips from persons who have just returned from swimming. In addition, spreading a wet towel over a chair provides a greater surface for drying the towel.

Despite all these advantages, there is a problem that the towel is easily dislodged from the chair. A slight wind blows the towel away, persons getting up from the chair cause the towel to fall off or folding a portion of the chair into an upright or semi-upright position results in slippage of the towel away from the upright portion of the chair.

Thus, it can be seen that a simple, convenient means for attaching a towel to the chair would be very useful for persons at the beach or lounging in the sun. The towel, of course, can serve the usual functions in addition to its application as a chair cover.

Of interest to the present invention are the following:

| Inventor(s) | Patent No. |
|---|---|
| Karr | 1,841,410 |
| Silvestri | 4,273,380 |
| Jones et al | 4,536,028 |
| Schulter | 4,656,670 |
| Short | D 280,170. |

Karr '410 discloses a means to hold a plurality of pads or mattress members in an assembled relation by means of strap members extending diagonally across each corner of the pad member. The straps are not elastic, are in all four corners and are directed to mattresses.

A combined beach towel, chair cover, tote bag disclosed by Silvestri '380 has pockets at either end. One of these pockets is large enough to store the entire towelling. Further, the device has draw strings for closure.

Jones et al '028 teaches a fitted sheet with pocket formations at each end to fit over the ends of the chair. A pair of transverse elastic straps are located at approximately one-third the length of the sheet from each end.

A combination beach towel and robe is taught by Schulter '670. The towel has an opening in the center. One end of the towel is configured as a pocket which facilitates its use as a cover for a car seat.

Short '170 discloses a combined beach towel and pillow.

None of the above provide a means for having a towel which can serve a normal towel function and also serve as a simple cover for a chair which is simple and easy to put in place.

SUMMARY OF THE INVENTION

Accordingly, it is the primary object of the present invention to provide a cover for a beach chair, patio chair or lounge chair which is simple and rapid to install.

It is still another object of the present invention to provide a cover for a beach chair which does not blow off, provides for the user's comfort and can serve a normal towel function.

In accordance with the teachings of the present invention, there is disclosed a combination beach towel and chair cover comprising a rectangular fabric towel which has a pair of side edges, a first elastic fabric strap permanently attached to a first end of the towel and a pair of spaced apart second elastic fabric straps permanently attached angularly at a second end of the towel.

The first elastic strap is attached parallel to, and approximately 6 to 20 inches from the first end of the towel. The elastic strap has a first end and a second end and the ends are attached approximately 2 to 3 inches from the side edges of the towel.

The first elastic strap is approximately 19 inches in length.

The pair of second elastic straps each have a first end and a second end. The first end of each strap is attached approximately 9 to 12 inches from the second end of the towel and approximately 2 to 3 inches from the side edges of the towel. The second end of each strap is attached approximately 2 to 3 inches from the second end of the towel and approximately 9 to 12 inches from the side edges. Each second strap is thusly attached at an angle of 45° with respect to the second edge of the towel.

Each second strap is approximately 10 to 13½ inches long.

The fabric of the towel is terrycloth or other suitable absorbent fabric.

The first elastic strap may be mounted in an end of the chair to encircle the end of the chair. The pair of second elastic straps may be mounted on an opposite end of the chair such that the towel is retained on the chair, will not be easily dislodged, provides a cover for the chair and is extended over the chair for rapid drying.

The towel may be used for ordinary beach use.

These and other objects of the present invention will become apparent from a reading of the following specification, taken in conjunction with the enclosed drawings.

BRIEF DESCRIPTION OF THE PREFERRED EMBODIMENTS

Figure 1:
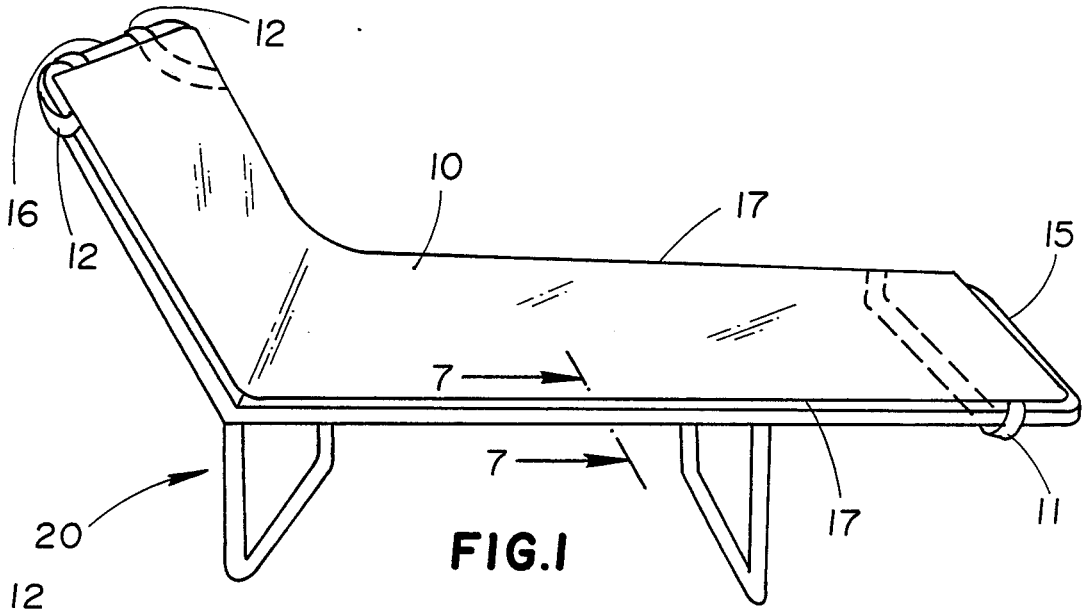
FIG. 1 is a perspective view of a beach chair on which is mounted the combination beach towel and chair cover showing the elastic straps encircling the ends of the chair.
Figure 2:
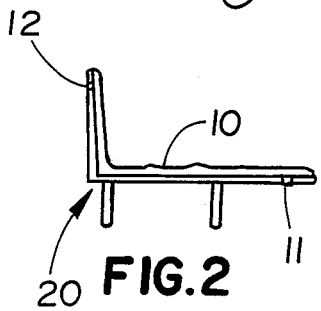
FIG. 2 is a side elevation showing the chair having the towel mounted thereon. The chair is in the upright position and the towel is taut.
Figure 3:
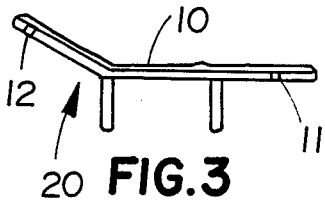
FIG. 3 is a side elevation as in FIG. 2 with the chair in the semi-upright position.
Figure 4:
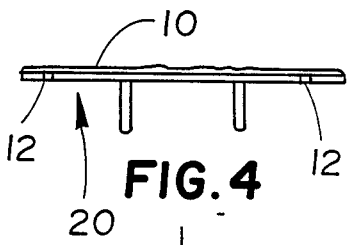
FIG. 4 is a side elevation as in FIG. 2 except that the chair is in a fully extended, horizontal position.
Figure 7:
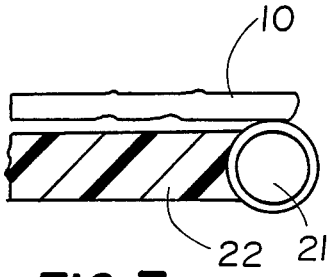
FIG. 7 is a cross-sectional view taken across the lines 7—7 of FIG. 1 showing the towel above the surface of the chair.

With reference to FIG. 1, there is illustrated a typical beach chair 20 having the towel 10 mounted thereon. The first elastic strap 11 encircles one end of the chair 20 and the second pair of elastic straps 12 encircle the opposite end of the chair 20. As shown in FIGS. 2 to 4, the towel 10 is effectively retained in any position of the chair 20 from completely upright to completely horizontal. The positioning of the towel 10 to the chair frame 21 and surface 22 is illustrated in FIG. 7 showing the towel 10 covering the surface 22 so that the user rests only on the towel 10.

Figure 5:
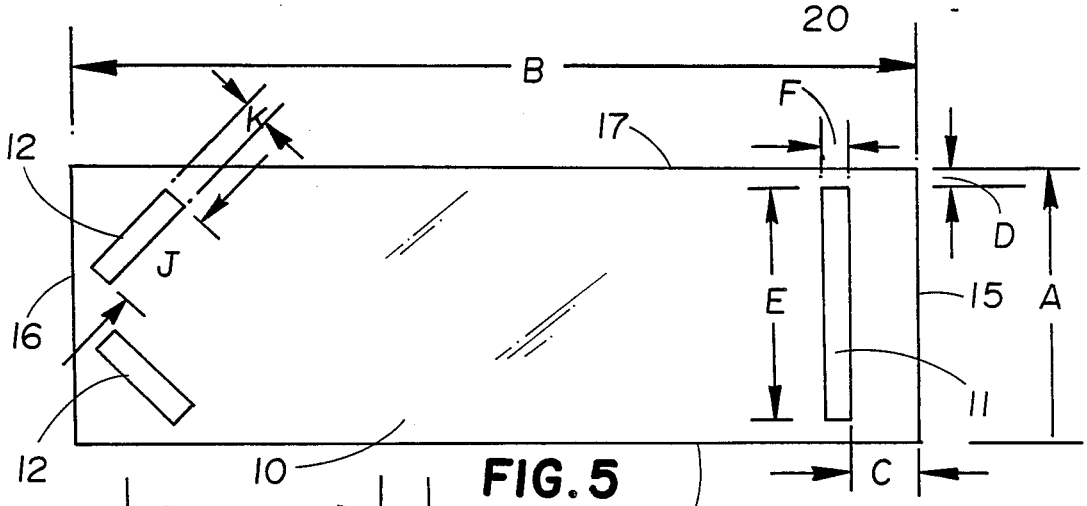
FIG. 5 is a bottom plan view of the towel showing the elastic straps attached to the towel.
Figure 6:
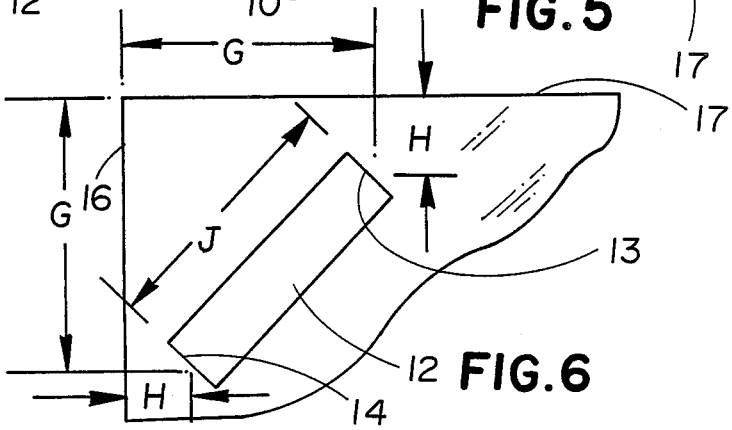
FIG. 6 is a portion of FIG. 5 drawn to an enlarged scale and showing details and dimensions for attachment of the second elastic strap.

As shown in the bottom view of the towel 10, FIG. 5, the towel 10 is approximately 2 ft. wide (A) by 6 to 7 feet long (B). The first elastic strap 11 is substantially parallel to, and approximately 6 to 20 inches (C) from, the first end of the towel 15. The first strap is attached approximately 2 to 3 inches (D) from the side edge of the towel 17. The strap is approximately 19 inches long (E) and approximately ½ to 2 inches (F) wide. The pair of second straps 12 are attached near the second end of the towel 16. As more clearly shown in FIG. 6, the first end 13 of the second strap 12 is approximately 9 to 12 inches (G) from the second end of the towel 16 and approximately 2 to 3 inches (H) from the side edge of the towel 17. The second end 14 of the second strap 12 is approximately 2 to 3 inches (H) from the second end of the towel 16 and approximately 9 to 12 inches (G) from the side edge of the towel 17. Thus, the second straps 12 are spaced apart and attached to the towel 10 at an angle of approximately 45° with respect to the second end of the towel 16. The second straps 12 are approximately 9 to 13½ inches (J) in length and are approximately ½ to 2 inches (K) in width. The above locations are measured from the midpoint of the width of the strap.

Figure 9:
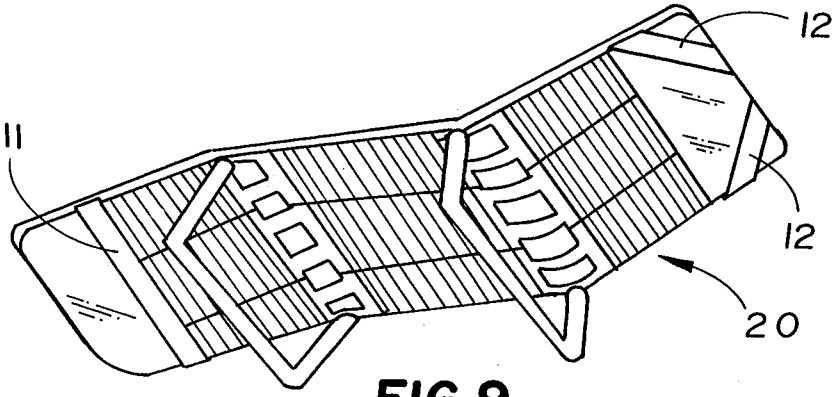
FIG. 9 is a perspective view of the underside of a beach chair showing the mounting of the towel thereon.

The towel 10 mounted on a chair 20 is shown in FIG. 9 viewed from the underside of the chair 20. This more clearly shows the location of the straps with relation to the ends of the chair 20.

Figure 8:
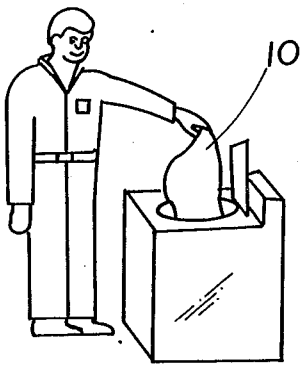
FIG. 8 is a perspective view of a person placing the towel in a standard washing machine for laundering.

The towel 10 can be utilized as any other towel and is laundered without special handling as in FIG. 8.

Figure 10C:
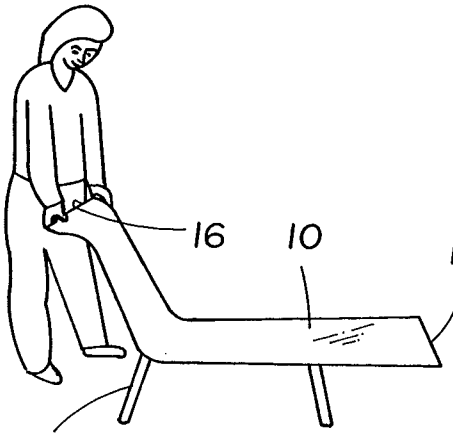
FIG. 10 A–C is a sequence of perspective views showing placement of the towel on one end of a lounge chair, contouring the towel to the chair and attaching the second end of the towel to the opposite end of the chair.
Figure 10B:
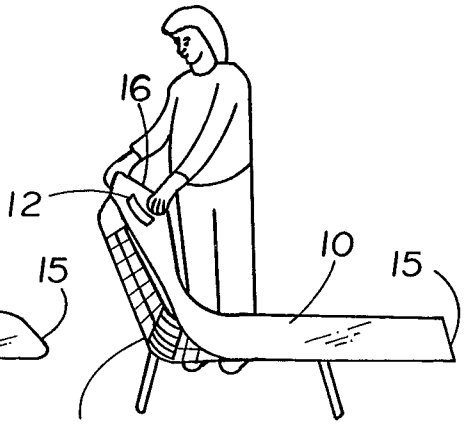
Figure 10A:
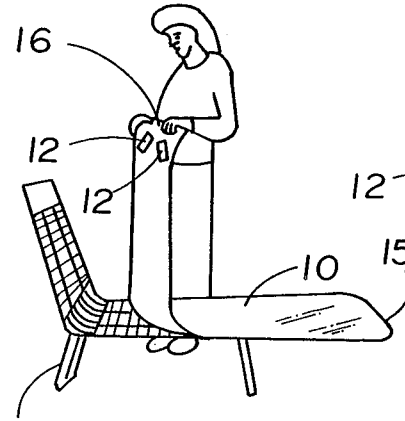

FIGS. 10 A–C show the mounting of the towel 10 on a beach chair 20. The first end of the towel 15 is attached to one end of the chair 20 by encircling the end of the chair 20 with the first strap 11. The towel is then contoured to the chair and the second end of the towel 16 is attached to the opposite end of the chair by engaging each of the pair of second straps 12.

Figure 11:
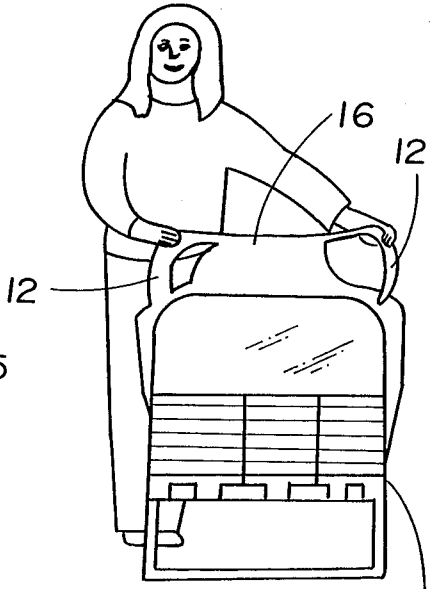
FIG. 11 is a perspective view showing placement of the second end of the towel and the pair of elastic straps over the end of the chair.

FIG. 11 more clearly shows the pair of second straps 12 being stretched to easily fit the end of the chair 20.

Figure 12A:
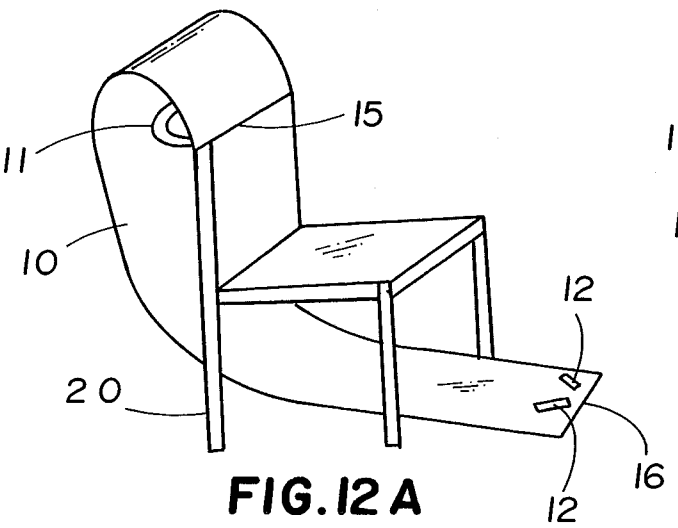
FIG. 12 A–C is a sequence of perspective views showing placement on the towel on a first end of a small chair, passing the towel under the chair, bringing the second end of the towel over the second end of the chair and attaching the second end of the towel over the first end of the chair.
Figure 12B:
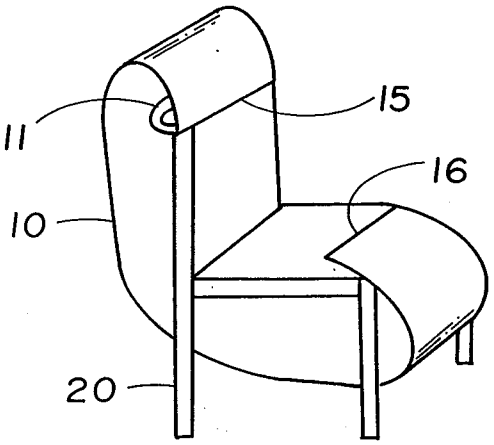
Figure 12C:
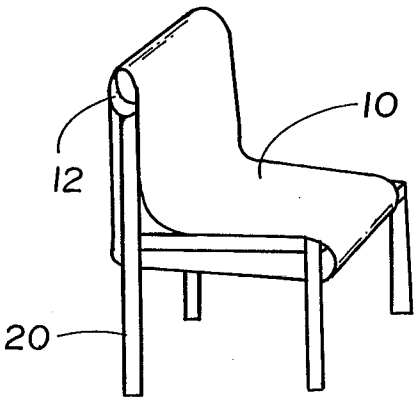

FIGS. 12 A–C showing the mounting of the towel 10 on a smaller chair 20. The first end of the towel 15 is attached to one end of the chair 20 by encircling the end of the chair with the first strap 11. The towel 20 is drawn over the back of the chair 20 and passed beneath the seat of the chair 20 to the front of the chair 20. The towel 10 is contoured to the chair and the second end of the towel 16 is engaged on the chair 20 over the first end of the towel 15 using the pair of second straps 12.

Figure 13A:
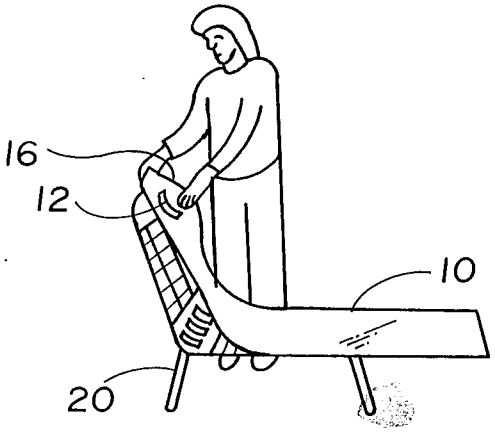
FIG. 13 A–C is a sequence of perspective views showing removal of one end of the towel from the chair, wiping a person's hands and face with the one end of the towel while the second end of the towel remains attached to the chair and replacing the one end of the towel on the chair.
Figure 13B:
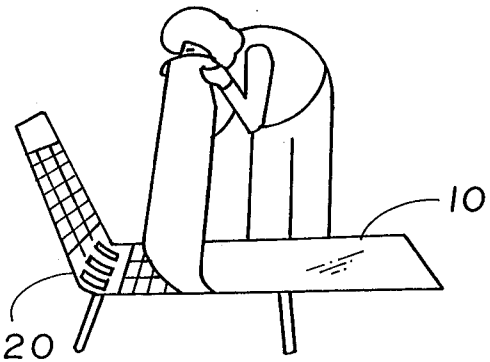
Figure 13C:
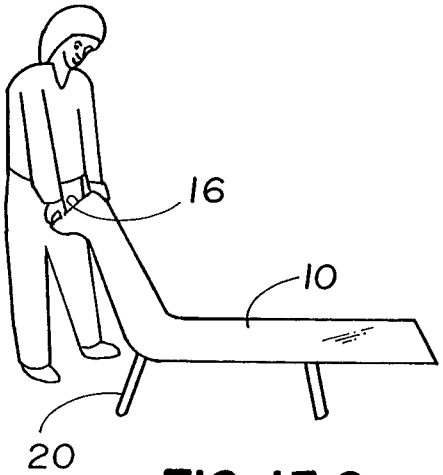

FIGS. 13 A–C show a sequence in which the towel 10 is attached to the chair 20 and an individual removes the second end of the towel 16 from the chair 20 to dry his/her hands and face without removing the entire towel 10 from the chair 20. The individual then replaces the second end of the towel 16 on the chair 20. This is simply and easily accomplished due to the convenient design of the towel 10.

Furthermore, the towel 10 can be utilized as a beach cover or for conventional drying purposes demonstrating its universal applicability.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A combination beach towel and chair cover comprising a rectangular planar fabric towel having a pair of side edges and a pair of ends and further having a first elastic fabric strap permanently attached at the first end of the towel spaced from side edges and ends of said towel, and a pair of spaced apart second elastic fabric straps permanently attached angularly at the second end of the towel the ends of said second straps being spaced inwardly from the side edges and end of the towel, said second straps being on opposite sides of a central axis parallel to the side edges of the towel, said second straps being generally symmetrically arranged relative to said central axis and being oriented such that a line along a strap, going from the end of the towel nearest to the strap, to the side edge nearest to the strap would form an acute angle with said central axis.

2. The combination beach towel and chair cover of claim 1, wherein the first elastic strap has a first end and a second end, the elastic strap being attached parallel to, and approximately 6 to 20 inches from the first end of the towel.

3. The combination beach towel and chair cover of claim 2, wherein the ends of the elastic strap are each attached approximately 2 to 3 inches from the side edges of the towel.

4. The combination beach towel and chair cover of claim 2, wherein the first elastic strap is approximately 19 inches long.

5. The combination beach towel and chair cover of claim 1, wherein the pair of second elastic straps each have a first end and a second end, the first end of each strap being attached approximately 9 to 12 inches from the second end of the towel and approximately 2 to 3 inches from the side edges of the towel and the second end of each strap being attached approximately 2 to 3 inches from the second end of the towel and approximately 9 to 12 inches from the side edges of the towel such that each second strap is attached at an angle of approximately 45° with respect to the second end of the towel.

6. The combination beach towel and chair cover of claim 5, wherein each second strap is approximately 9 to 13½ inches long.

7. The combination beach towel and chair cover of claim 1, wherein the fabric is terrycloth.

8. The combination beach towel and chair cover of claim 1, wherein the first elastic strap may be mounted on an end of a chair to encircle the end of the chair and the pair of second elastic straps may be mounted on an opposite end of the chair such that the towel is retained on the chair, will not easily be dislodged, provides a cover for the chair and is extended over the chair for rapid drying of the towel.

9. The combination beach towel and chair cover of claim 1, wherein the towel may be used for ordinary beach use.

10. A combination beach towel and chair cover comprising:

a rectangular fabric towel having a pair of side edges and a pair of ends and further having a first elastic fabric strap permanently attached at the first end of the towel and a pair of spaced-apart elastic fabric straps permanently attached angularly at the second end of the towel;

the first elastic strap being approximately 19 inches long having a first end and a second end, the strap being attached approximately 6 to 20 inches from the first end of the towel, the ends of the strap each being attached approximately 2 to 3 inches from the side edges of the towel;

the pair of second elastic straps each being approximately 9 to 13½ inches long, each having a first end and a second end, the first end of each strap being attached approximately 9 to 12 inches from the second end of the towel and approximately 2 to 3 inches from the side edges of the towel and the second end of each strap being attached approximately 2 to 3 inches from the second end of the towel and approximately 9 to 12 inches from the side edges of the towel such that each strap is attached at an angle of approximately 45° with respect to the second end of the towel; and such that the first elastic strap may be mounted on an end of a chair to encircle the end of the chair and the pair of second elastic straps may be mounted on an opposite end of the chair such that the towel is retained on the chair, will not be easily dislodged, provides a cover for the chair and is extended over the chair for rapid drying of the towel.

11. A combination beach towel and chair cover, especially adapted to be universally fitted onto articulatable lounge chair having a range of sizes and designs and further having respective backs and end portions, comprising a substantially rectangular towel made from a substantially terrycloth material, the towel having respective top and bottom surfaces and further having respective pairs of side and end edges, thereby forming four respective corners for the towel, a first elastic strap secured to the bottom of the towel, substantially parallel to one of the end edges of the towel and spaced therefrom, a pair of second elastic straps secured to the bottom of the towel at the other end thereof, each of the second elastic straps being arranged angularly with respective to a respective corner of the towel and spaced therefrom at the other end of the towel, whereby the one end of the towel may be folded over the end of the chair, such that the end of the chair is slipped through the first elastic strap, whereby the other end of the towel may be folded over the back of chair, such that the back of the chair is fitted through the second elastic straps at the other end of the towel, whereby the towel may be attached to the chair easily and conveniently, whereby the wind will not blow the towel off the chair, whereby the towel will accommodate a variety of lounge chair designs and sizes in a given range, whereby the towel will remain substantially taut and will not sag even though the chair may be articulated into its different positions, and whereby the towel may be removed from the chair easily and conveniently, used for drying off if desired, and subsequently thrown into a washer as an ordinary towel.

12. The combination beach towel and chair cover of claim 11, wherein the first and second elastic straps have covers made of a substantially terrycloth material.

* * * * *